US006379268B1

(12) United States Patent
Yamagishi et al.

(10) Patent No.: US 6,379,268 B1
(45) Date of Patent: Apr. 30, 2002

(54) GOLF BALL

(75) Inventors: Hisashi Yamagishi; Takashi Maruko; Atsushi Nakamura; Jun Shindo, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/487,778

(22) Filed: Jan. 20, 2000

(30) Foreign Application Priority Data

Mar. 5, 1999 (JP) ..... 11-053818

(51) Int. Cl.[7] ..... A63B 37/04
(52) U.S. Cl. ..... 473/371; 473/378
(58) Field of Search ..... 473/367, 368, 473/371, 376, 377, 378

(56) References Cited

U.S. PATENT DOCUMENTS 5,253,871 A * 10/1993 Viollaz ..... 473/378
5,586,950 A * 12/1996 Endo ..... 473/356
5,702,312 A * 12/1997 Horiuchi et al. ..... 473/377
5,713,802 A * 2/1998 Moriyama et al. ..... 473/374
5,730,664 A * 3/1998 Asakura et al. ..... 473/373
5,820,486 A * 10/1998 Tanaka et al. ..... 473/374
5,830,087 A * 11/1998 Sullivan et al. ..... 473/385
5,833,554 A * 11/1998 Sullivan et al. ..... 473/374
6,068,561 A * 5/2000 Renard et al. ..... 473/364

* cited by examiner

*Primary Examiner*—Mark S. Graham
*Assistant Examiner*—Raeann Gorden
(74) *Attorney, Agent, or Firm*—Sughrue Mion, PLLC

(57) ABSTRACT

A golf ball comprising a core, a cover inner layer and a cover outer layer has a plurality of dimples on the surface. The JIS-C hardness of the ball decreases successively within specific ranges from the cover outer layer to the cover inner layer to the core surface, but is substantially uniform within a central portion of the core. The dimples are of at least three types having different diameters and have an average diameter of 3.3–4.0 mm and an average depth of 0.11–0.17 mm, with the ratio of average diameter to average depth being from 25 to 33. The total number of dimples is from 380 to 450. The ball exhibits a relatively large deflection and a high resilience on impact which enable it to achieve an improved distance, as well as a good feel.

3 Claims, No Drawings

GOLF BALL

The present invention relates to a golf ball having a multilayer construction of at least three layers comprising a core, a cover inner layer and a cover outer layer. More particularly, it relates to a golf ball having ample rebound characteristics, an excellent distance and overall flight performance, and an excellent feel when hit with a golf club.

BACKGROUND OF THE INVENTION

A variety of multi-piece golf balls, including three- piece and four-piece balls, have been developed over the past few years in order to improve ball performance.

Such multi-piece golf balls represent an effort to improve the controllability of two-piece balls while retaining their distance and other flight characteristics. Yet, there remains a need for multi-piece solid golf balls having also better resilience and good spin characteristics.

SUMMARY OF THE INVENTION

An object of the present invention is to provide a golf ball having a multilayer construction of at least three layers which has ample rebound characteristics, an excellent distance and overall flight performance, and an excellent feel when hit with a golf club.

The invention provides a golf ball having a multilayer construction of at least three layers, comprising a core, a cover inner layer enclosing the core, and a cover outer layer enclosing the cover inner layer, the ball having a plurality of dimples formed on a surface thereof. The ball has a JIS-C hardness C at a radial distance L in millimeters from the surface of the ball toward its center, which C satisfies the conditions: (1) $93-1.3L \geqq C \geqq 83-1.3L$ when L is from 0 mm to less than 10 mm, and (2) $67 \leqq C \leqq 80$ when L is from 10 mm to the radius of the ball. The hardness C decreases successively from the cover outer layer to the cover inner layer to the core surface. The region of the ball extending from L=8 mm to the center of the ball has a uniform hardness within a measurement error of ±3 JIS-C hardness units. The plurality of dimples include at least three types of dimples having different diameters, the dimples have an average diameter of 3.3 to 4.0 mm and an average depth of 0.11 to 0.17 mm, and the ratio of the average diameter to the average depth is from 25/1 to 33/1. The total number of dimples is from 380 to 450.

In preferred embodiments, the cover outer layer is made of a thermoplastic resin having a JIS-C hardness of 83 to 93, and the cover inner layer is made of a thermoplastic resin having a JIS-C hardness of 75 to 85. In a further preferred embodiment, the core has a JIS-C hardness of 70 to 80 at its surface, the region of the core extending from 2 mm below its surface to its center has a uniform hardness within a measurement error of ±3 JIS-C hardness units, and the hardness at the surface of the core is at least 3 JIS-C hardness units higher than the hardness at the center of the core.

The invention focuses on the hardness of the golf ball from its surface toward the interior. The golf ball is given such a hardness distribution that the hardness decreases successively from the cover outer layer to the cover inner layer to the core surface, but is uniform within a central portion of the core. With this construction, the process of ball deformation at the time of impact takes place more effectively, thus providing ample rebound characteristics. In addition, the cover outer layer is made relatively hard, thereby giving the ball an overall construction which has a relatively large deflection. The spin rate incurred by the ball upon impact with a driver may decrease somewhat on account of this construction, but such an effect is mitigated by optimizing the dimple parameters so as to take full advantage of the initial conditions and characteristics arising from the construction of the ball.

DETAILED DESCRIPTION OF THE INVENTION

As noted above, the golf ball of the invention has a multilayer construction comprising at least a core, a cover inner layer enclosing the core, and a cover outer layer enclosing the cover inner layer. It is noted that the ball and the core, which are spheres, each have a center and a surface; the cover inner or outer layer has inside and outside surfaces, the outside surface being herein referred to simply as the surface; and the distance is determined in a radial direction. Herein, L represents a radial distance from the surface of the ball toward its center in millimeters. The ball is divided at a radial distance of 10 mm from the surface into two regions: region (1) where L is from 0 mm to less than 10 mm ($0 \leqq L \leqq 10$), and region (2) where L is from 10 mm to the radius R of the ball ($10 \leqq L \leqq R$). Understandably, L equal to the radius of the ball means that the position reaches the center of the ball. According to the invention, the local hardness of the ball is optimized in these two regions.

Specifically, provided that the ball has a local JIS-C hardness C at any radial distance L, the ball must satisfy both of the following conditions:

$93-1.3L \geqq C \geqq 83-1.3L$, and preferably $91-1.3L \geqq C \geqq 81-1.3L$, at any position in region (1) and $67 \leqq C \leqq 80$, and preferably $68 \leqq C \leqq 78$, at any position in region (2).

Moreover, the golf ball of the invention must also satisfy, under these hardness conditions, the requirement that the region of the ball extending from L=8 mm to the core center has a substantially uniform hardness. The phrase "substantially uniform hardness" here signifies a measurement error tolerance of ±3 JIS-C hardness units when the ball is cut into two halves and the cut face is actually measured.

In the invention, the core may be a conventional solid core and made of a known rubber composition, and preferably one comprising polybutadiene as the base rubber. The use of 1,4-polybutadiene having a cis structure of at least 40% is especially suitable. Where desired, other suitable rubber ingredients such as natural rubber, polyisoprene rubber or styrene-butadiene rubber may be compounded with the polybutadiene to give the base rubber. The resilience of the golf ball can be improved by increasing the proportion of the rubber component. Less than about 10 parts by weight of the other rubber ingredients may be compounded per 100 parts by weight of the polybutadiene.

A crosslinking agent may be included in the rubber composition. Exemplary crosslinking agents are the zinc and magnesium salts of unsaturated fatty acids, such as zinc dimethacrylate and zinc diacrylate, and ester compounds such as trimethylpropane methacrylate. Zinc diacrylate is especially preferred for high resilience. The crosslinking agent is preferably included in an amount of about 10 to 40 parts by weight per 100 parts by weight of the base rubber.

A vulcanizing agent is generally compounded in the rubber composition. It is recommended that the vulcanizing agent include a peroxide having a one minute half-life temperature of not more than 155° C. in an amount, based on the overall vulcanizing agent, of preferably at least 30% by weight, and especially 40 to 70% by weight. Examples of suitable peroxides include commercially available products such as Perhexa 3M (manufactured by Nippon Oils and Fats Co., Ltd.). The amount of vulcanizing agent included in the rubber composition is preferably from about 0.6 to 2 parts by weight per 100 parts by weight of the base rubber.

If necessary, other suitable ingredients may also be incorporated in the rubber composition, such as antioxidants and fillers (e.g., zinc oxide, barium sulfate) for modifying the specific gravity. The specific gravity modifier is typically blended in an amount of about 1 to 30 parts by weight per 100 parts by weight of the base rubber.

The core can be produced by using a known method to vulcanize and cure the above rubber composition in a mold. The resulting core may be composed of a single layer or have a multilayer construction of two or more layers. The core typically has a diameter of 24 to 41 mm, and especially 25 to 40 mm.

It is recommended that the core of the inventive golf ball have a JIS-C hardness on the surface of 70 to 80, and especially 71 to 79 (surface hardness). In addition, preferably, the region of the core extending from 2 mm below the core surface to the core center has a substantially uniform hardness (internal hardness) within a measurement error of ±3 JIS-C hardness units. Also preferably, the surface hardness of the core is at least 3 JIS-C hardness units higher, and especially at least 4 units higher, than the internal or center hardness of the core. A hardness difference of less than 3 units may cause inefficient energy propagation between the core and the adjoining layer, resulting in poor resilience.

In the golf ball of the invention, the solid core is enclosed within a cover composed of at least a cover inner layer and a cover outermost layer, each of which may be made of a known cover stock material such as a thermoplastic resin.

In the practice of the invention, the cover inner layer is preferably made of a thermoplastic resin having a JIS-C hardness of 75 to 85, and especially 77 to 83, and the cover outermost layer is preferably made of a thermoplastic resin having a JIS-C hardness of 83 to 93, and especially 84 to 92. It is critical that the inventive golf ball be formed so that the hardness decreases successively from the cover outermost layer to the cover inner layer to the core surface. If a cover intermediate layer is provided between the cover outermost and inner layers, it is given a hardness which is not higher than that of the cover outermost layer and not lower than that of the cover inner layer.

The hardness difference between the cover outermost layer and the core surface is preferably 2 to 40 JIS-C units, and especially 4 to 35 units. The hardness difference between the cover outermost layer and the cover inner layer is preferably 1 to 20 JIS-C units, and especially 2 to 15 units. The hardness difference between the cover inner layer and the core surface is preferably 1 to 15 JIS-C units, and especially 2 to 13 units.

Each of these cover layers can be made of a suitable known thermoplastic material such as an ionomer resin.

Preferably, the cover has an overall thickness of 2 to 15 mm, and especially 3 to 12 mm. More specifically, the cover outermost layer may be set at a thickness of 0.5 to 5 mm, and especially 1 to 4 mm, while the cover inner layer may be set at a thickness of 0.5 to 10 mm, and especially 1 to 8 mm.

As in conventional golf balls, the golf ball of the invention has numerous dimples formed on the surface of the cover outermost layer. Various dimple shapes and arrangements may be selected, although the cover outermost layer must have formed on the surface at least three types of dimples, and preferably three or four types, each of different diameter. The dimples must have an average diameter of 3.3 to 4.0 mm, and preferably 3.35 to 3.9 mm, and must have an average depth of 0.11 to 0.17 mm, and preferably 0.12 to 0.16 mm. The ratio of the average dimple diameter to the average dimple depth is from 25 to 33, and preferably from 25.5 to 31. The total number of dimples is from 380 to 450, and preferably from 390 to 440. This combination of dimple parameters serves to mitigate the decline in spin rate due to the ball's construction.

"Average diameter" refers herein to the average for the plurality of dimple types of differing diameters, and "average depth" refers to the average for the plurality of dimple types of differing depths.

The golf ball of the invention may be formed so as to have a diameter and weight which conform with the Rules of Golf. That is, the ball may have a diameter of from 42.60 to 42.75 mm and a weight of from 45.1 to 45.93 g.

The inventive golf ball has a relatively large deflection and a high resilience on impact which enable it to achieve an improved distance, as well as a good feel.

EXAMPLE

Examples of the invention and comparative examples are given below by way of illustration, and are not intended to limit the invention.

Examples 1–5 and Comparative Examples 1–4

In each example, golf balls were obtained that had a core, cover inner layer and cover outer layer produced under the same conditions from the materials shown in Tables 1 and 2. The dimple configurations on the balls are shown in Table 3. The local hardnesses of the balls are shown in Tables 4 and 5.

The properties of these golf balls were measured and evaluated as described below. The results are shown in Tables 6 and 7.

Flight Performance

The golf balls obtained in each example were measured for spin rate, carry and total distance when hit with a No. 1 wood (here and below, a "230 Ti" driver with a loft angle of 9.5° manufactured by Bridgestone Sports Co., Ltd.) at a head speed of 45 m/s (HS45) using a swing robot.

Coefficient of Restitution (C.O.R.)

Each ball was shot at a velocity of 38 m/s against a vertical steel plate of sufficient weight. The coefficient of restitution was determined by computing the ratio of the ball's velocity before striking the plate (forward velocity) to its velocity after striking the plate (rebound velocity).

Contact Area Ratio (%)

The golf ball was hit with a No. 1 wood at a head speed of 45 m/s using a swing robot. The contact area between the club face and the ball at the time of impact was measured using pressure-sensitive paper. The ratio of this contact area to the contact area measured for the golf ball obtained in Example 1 was determined and expressed as a percentage.

Feel

Three professional golfers hit the golf ball obtained in each example with a No. 1 wood. The ball was rated as follows.

Exc: All three golfers thought ball had an appropriately soft, yet solid feel.

Good: Two of the golfers thought ball had an appropriately soft, yet solid feel.

Poor: All three golfers thought the ball was too soft.

TABLE 1

| | Ingredients (pbw) | EX 1 | EX 2 | EX 3 | EX 4 | EX 5 |
|---|---|---|---|---|---|---|
| Core | Formulation | a | a | b | c | c |
| | Diameter (mm) | 30.7 | 30.7 | 30.7 | 32.7 | 32.7 |
| | Vulcanization conditions* | I | I | I | I | I |
| | cis-1,4-Polybutadiene | 100 | 100 | 100 | 100 | 100 |
| | Zinc diacrylate | 26 | 26 | 20 | 29 | 29 |
| | Zinc oxide | 10 | 10 | 10 | 10 | 10 |
| | Barium sulfate | 10 | 10 | 13 | 31 | 31 |
| | Antioxidant | 0.2 | 0.2 | 0.2 | 0.2 | 0.2 |
| | Dicumyl peroxide | 1 | 1 | 1 | 1 | 1 |
| Cover inner layer | Thickness (mm) | 4.0 | 4.0 | 4.0 | 3.0 | 3.0 |
| | Hardness (JIS-C) | 85 | 85 | 79 | 88 | 88 |
| | Himilan 1605 | — | — | — | — | — |
| | Himilan 1706 | — | — | — | 25 | 25 |
| | Himilan 1707 | — | — | — | — | — |
| | Himilan 1650 | — | — | — | 75 | 75 |
| | Formulation | f | f | g | — | — |
| | Vulcanization conditions* | II | II | II | — | — |
| | cis-1,4-Polybutadiene | 100 | 100 | 100 | — | — |
| | Zinc diacrylate | 38 | 38 | 27 | — | — |
| | Zinc oxide | 10 | 10 | 10 | — | — |
| | Barium sulfate | 4.8 | 4.8 | 10 | — | — |
| | Antioxidant | 0.2 | 0.2 | 0.2 | — | — |
| | Dicumyl peroxide | 1 | 1 | 1 | — | — |
| Cover outer layer | Thickness (mm) | 2.0 | 2.0 | 2.0 | 2.0 | 2.0 |
| | Himilan 1605 | 40 | 40 | 50 | 40 | 40 |
| | Himilan 1706 | 30 | 30 | — | 30 | 30 |
| | Himilan 1707 | 30 | 30 | — | 30 | 30 |
| | Himilan 1557 | — | — | 50 | — | — |
| | Hardness (JIS-C) | 91 | 91 | 85 | 91 | 91 |
| Dimple configuration (see Table 3) | | A | B | A | C | A |

*Vulcanization conditions

I: 40 minutes of vulcanization at 125° C., followed by 10 minutes at 170° C.

II: 15 minutes of vulcanization at 170° C.

TABLE 2

| | Ingredients (pbw) | CE 1 | CE 2 | CE 3 | CE 4 |
|---|---|---|---|---|---|
| Core | Formulation | a | b | d | e |
| | Diameter (mm) | 30.7 | 30.7 | 30.7 | 32.7 |
| | Vulcanization conditions* | I | I | I | II |
| | cis-1,4-Polybutadiene | 100 | 100 | 100 | 100 |
| | Zinc diacrylate | 26 | 20 | 38 | 40 |
| | Zinc oxide | 10 | 10 | 10 | 10 |
| | Barium sulfate | 10 | 13 | 5 | 26 |
| | Antioxidant | 0.2 | 0.2 | 0.2 | 0.2 |
| | Dicumyl peroxide | 1 | 1 | 1 | 2 |
| Cover inner layer | Thickness (mm) | 4.0 | 4.0 | 4.0 | 3.0 |
| | Hardness (JIS-C) | 85 | 79 | 79 | 91 |
| | Himilan 1605 | — | — | — | 40 |
| | Himilan 1706 | — | — | — | 30 |
| | Himilan 1707 | — | — | — | 30 |
| | Himilan 1650 | — | — | — | — |
| | Formulation | f | g | g | — |
| | Vulcanization conditions* | II | II | II | — |
| | cis-1,4-Polybutadiene | 100 | 100 | 100 | — |
| | Zinc diacrylate | 38 | 27 | 27 | — |
| | Zinc oxide | 10 | 10 | 10 | — |
| | Barium sulfate | 4.8 | 10 | 10 | — |
| | Antioxidant | 0.2 | 0.2 | 0.2 | — |
| | Dicumyl peroxide | 1 | 1 | 1 | — |
| Cover outer layer | Thickness (mm) | 2.0 | 2.0 | 2.0 | 2.0 |
| | Himilan 1605 | 40 | 50 | 50 | 50 |
| | Himilan 1706 | 30 | — | — | — |
| | Himilan 1707 | 30 | — | — | — |
| | Himilan 1557 | — | 50 | 50 | 50 |
| | Hardness (JIS-C) | 91 | 85 | 85 | 85 |
| Dimple configuration (see Table 3) | | D | E | A | A |

*Vulcanization conditions

I: 40 minutes of vulcanization at 125° C., followed by 10 minutes at 170° C.

II: 15 minutes of vulcanization at 170° C.

TABLE 3

| | Dimples | | | | | | |
|---|---|---|---|---|---|---|---|
| | Diameter (mm) | Depth (mm) | Number | Average diameter (mm) | Average depth (mm) | Total number | Average diameter/ Average depth |
| A | 4.1 | 0.135 | 24 | 3.45 | 0.135 | 432 | 25.6 |
| | 3.9 | 0.135 | 60 | | | | |
| | 3.5 | 0.135 | 276 | | | | |
| | 2.3 | 0.135 | 72 | | | | |
| B | 4.1 | 0.155 | 24 | 3.4 | 0.129 | 432 | 26.5 |
| | 3.7 | 0.140 | 60 | | | | |
| | 3.5 | 0.132 | 276 | | | | |
| | 2.3 | 0.087 | 72 | | | | |
| C | 4.0 | 0.145 | 120 | 3.7667 | 0.1365 | 392 | 27.6 |
| | 3.8 | 0.138 | 200 | | | | |
| | 3.5 | 0.127 | 72 | | | | |

TABLE 3-continued

| | Dimples | | | | | | |
|---|---|---|---|---|---|---|---|
| | Diameter (mm) | Depth (mm) | Number | Average diameter (mm) | Average depth (mm) | Total number | Average diameter/ Average depth |
| D | 4.15 | 0.23 | 240 | 3.825 | 0.23 | 360 | 16.6 |
| | 3.5 | 0.23 | 120 | | | | |
| E | 4.0 | 0.113 | 120 | 3.7667 | 0.113 | 392 | 33.3 |
| | 3.8 | 0.113 | 200 | | | | |
| | 3.5 | 0.113 | 72 | | | | |

TABLE 4

| | | | EX 1 | EX 2 | EX 3 | CE 1 | CE 2 | CE 3 |
|---|---|---|---|---|---|---|---|---|
| Distance L from ball surface (mm) | 1 mm | cover outer layer | 91 | 91 | 85 | 91 | 85 | 85 |
| | 3 mm | cover inner layer | 85 | 85 | 80 | 85 | 80 | 80 |
| | 5 mm | cover inner layer | 84 | 84 | 77 | 84 | 77 | 77 |
| | 6 mm | core surface | 78 | 78 | 75 | 78 | 75 | 85 |
| | 9 mm | core | 73 | 73 | 68 | 73 | 68 | 82 |
| | 12 mm | core | 72 | 72 | 68 | 72 | 68 | 82 |
| | 15 mm | core | 72 | 72 | 67 | 72 | 67 | 82 |
| | 18 mm | core | 73 | 73 | 67 | 73 | 67 | 81 |
| | Center | core | 73 | 73 | 66 | 73 | 66 | 81 |

TABLE 5

| | | | EX 4 | EX 5 | CE 4 |
|---|---|---|---|---|---|
| Distance L from ball surface (mm) | 1 mm | cover outer layer | 91 | 91 | 85 |
| | 3 mm | cover inner layer | 88 | 88 | 91 |
| | 5 mm | core surface | 80 | 80 | 90 |
| | 9 mm | core | 75 | 75 | 93 |
| | 12 mm | core | 75 | 75 | 86 |
| | 15 mm | core | 74 | 74 | 78 |
| | 18 mm | core | 74 | 74 | 73 |
| | Center | core | 74 | 74 | 65 |

TABLE 6

| | | EX 1 | EX 2 | EX 3 | EX 4 | EX 5 |
|---|---|---|---|---|---|---|
| Flight performance (HS45) | Spin (rpm) | 2248 | 2250 | 2285 | 2240 | 2245 |
| | Carry (m) | 209.9 | 210.2 | 210.6 | 211.0 | 210.9 |
| | Total distance (m) | 223.5 | 223.8 | 222.9 | 223.9 | 223.7 |
| | Rating | Good | Good | Good | Good | Good |
| C.O.R. | | 0.785 | 0.786 | 0.787 | 0.792 | 0.792 |
| Contact area ratio | | 100.0 | 100.0 | 107.0 | 102.3 | 102.3 |
| Feel | | Good | Good | Exc | Exc | Exc |

TABLE 7

| | | CE 1 | CE 2 | CE 3 | CE 4 |
|---|---|---|---|---|---|
| Flight performance (HS45) | Spin (rpm) | 2250 | 2290 | 2380 | 2420 |
| | Carry (m) | 205.6 | 204.3 | 207.5 | 208.7 |
| | Total distance (m) | 217.5 | 215.8 | 216.5 | 220.0 |
| | Rating | Poor | Poor | Poor | Poor |
| C.O.R. | | 0.784 | 0.786 | 0.785 | 0.770 |
| Contact area ratio | | 100.0 | 107.0 | 90.7 | 125.6 |
| Feel | | Good | Exc | Poor | Exc |

Japanese Patent Application No. 11-058318 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball comprising at least a core, a cover inner layer enclosing the core, and a cover outer layer enclosing the cover inner layer, said ball having a plurality of dimples formed on a surface thereof, wherein, said ball has a JIS-C hardness C at a radial distance L in millimeters from the surface of the ball toward its center, wherein, C satisfies the conditions:

(1) $93-1.3L \geqq C \geqq 83-1.3L$ when L is from 0 mm to less than 10mm, and (2) $67 \leqq C \leqq 80$ when L is from 10 mm to the radius of the ball, said hardness C decreases from the cover outer layer to the cover inner layer to the core surface, and the region of the ball extending from L=8 mm to the center of the ball has a uniform hardness within a measurement error of ±3 JIS-C hardness units, the plurality of dimples include at least three types of dimples having different diameters, the dimples have an average diameter of 3.3 to 4.0 mm and an average depth of 0.11 to 0.17 mm, the ratio of the average diameter to the average depth is from 25/1 to 33/1, and the total number of dimples is from 380 to 450, and wherein the core has a JIS-C hardness of 70 to 80 at its surface, the region of the core extending from 2 mm below its surface to its center has a uniform hardness within a measurement error of ±3 JIS-C hardness units, and the hardness at the surface of the core is at least 3 JIS-C hardness units higher than the hardness at the center of the core.

2. The golf ball of claim 1, wherein the cover outer layer is made of a thermoplastic resin having a JIS-C hardness of 83 to 93.

3. The golf ball of claim 1, wherein the cover inner layer is made of a thermoplastic resin having a JIS-C hardness of 75 to 85.

* * * * *